United States Patent [19]

Roach, Jr.

[11] 4,269,461

[45] May 26, 1981

[54] CHRISTMAS TREE TRIM CABINET

[76] Inventor: Bobbie R. Roach, Jr., 621 Dunwich Way, Baltimore, Md. 21221

[21] Appl. No.: 63,077

[22] Filed: Aug. 2, 1979

[51] Int. Cl.[3] ..... A47F 3/00

[52] U.S. Cl. ..... 312/244; 206/564; 312/111; 312/345; 312/132; 294/161

[58] Field of Search ..... 206/387, 457, 564; 312/108, 111, 132, 244, 345, 350; 224/45 G

[56] References Cited

U.S. PATENT DOCUMENTS

| | | | |
|---|---|---|---|
| 3,510,049 | 5/1970 | Donovan | 229/2.5 EC |
| 3,604,773 | 9/1971 | Haynes et al. | 312/244 |
| 4,082,390 | 4/1978 | Gibson et al. | 312/244 |
| 4,123,128 | 10/1978 | Abele | 312/244 |

*Primary Examiner*—Casmir A. Nunberg
*Attorney, Agent, or Firm*—John F. McClellan, Sr.

[57] ABSTRACT

A Chrismas tree ball display cabinet and storage cabinet has a plurality of drawers of styrofoam with a grid of ball-fitting spherical recesses in the top surface of each, a vertically spaced succession of ledge-like shelves supporting the styrofoam drawers, and in the preferred embodiment a compartmented drawer for Christmas tree ball accessories; a vertically sliding door gives access to the contents, and transparent plastic construction for the cabinet and white color for the styrofoam in preferred embodiment make the assembly when filled with Christmas tree balls an effective display for store or home as well as for storage.

3 Claims, 6 Drawing Figures

CHRISTMAS TREE TRIM CABINET

This invention relates generally to apparatus for holding items and particularly to multi-drawer apparatus of this kind.

A principal object of this invention is to provide a novel combination of display cabinet and storage cabinet for Christmas tree ornaments, particularly balls.

Further objects are to provide apparatus as described which enables a purchaser in a store to select from pre-sorted classes of Christmas tree balls displayed for viewing from all sides in transparent cabinets but protected from breakage in transit or storage by special drawer structure; to provide apparatus which is suitable for year-around display or storage by special drawer structure; to provide apparatus which is suitable for year-around display or storage in the home; to provide apparatus which will not accidentally open when carried by the handle or set on the base, and which is light in weight and easily adaptable to fit any size Christmas tree ball in common use.

Still further objects are to provide apparatus as described which provides instant access to Christmas tree balls stored or displayed in it, but which is substantially equally compact with the door open or closed.

And yet further objects are to provide apparatus as described which is handsome in appearance, versatile, durable, economical and which conveniently stores hooks and other accessories for ornaments.

The above and other objects and advantages of this invention will become more readily understood on examination of the following description including the drawings, in which like reference numerals refer to like parts:

FIG. 1 shows the cabinet 20 of this invention, which preferably is made of transparent sheet such as "Plexiglass" and may be of molded construction.

Figure 1:
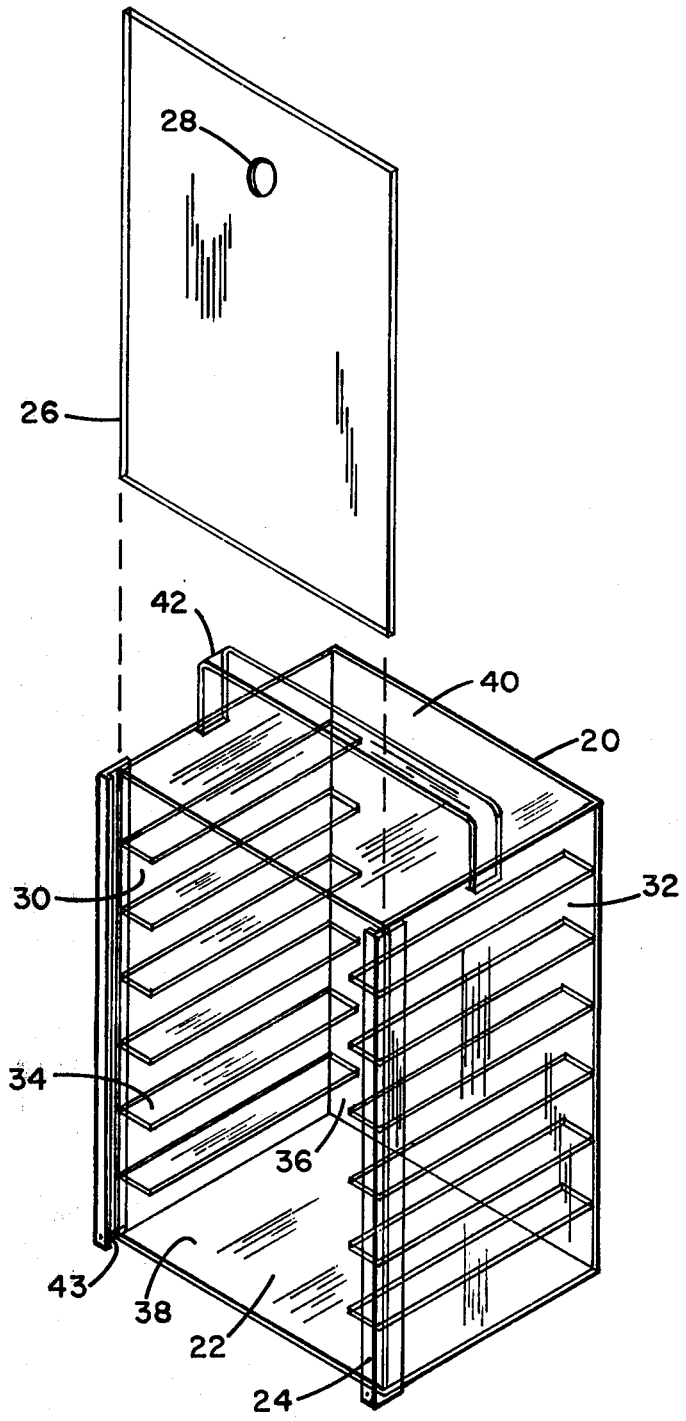
FIG. 1 is an exploded perspective view of a display and storage cabinet according to this invention.

The cabinet is generally rectangular in the shape of a box with an open front 22 with an inturned flange 24 along each vertical margin to hold a sliding door 26, also transparent. The sliding door preferably has a flush or non-snagging handgrip for raising and/or removing it, in the form of a circular hole 28 near the top.

Fixed along the left wall 30 and the right wall 32 are respective pluralities of ledge-like shelves 34 running from the front opening to the back wall 36 in preferably uniformly parallel-spaced vertical levels corresponding on each side, from bottom 38 to top 40. A handle 42 on the transverse centerline across the top provides carrying means. A stop 43 limits the downward sliding of the door.

It will be appreciated that this construction is suited for high volume injection moulding; if desired the inturned flanges can be cemented on after the remainder of the three-sided box-shape is moulded.

Figure 2:
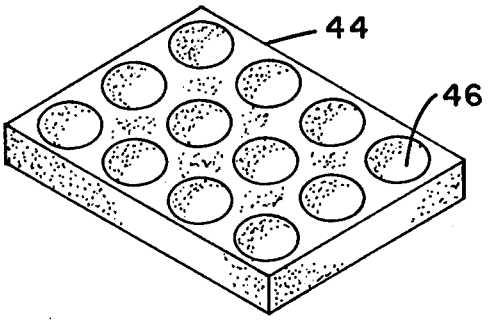
FIG. 2 is a perspective view of a Christmas tree ornament drawer to fit one size Christmas tree ball.

FIG. 2 shows the novel type drawer 44 of this invention, which takes advantage of the pleasing appearance, strength and stiffness and ease of fabrication of styrofoam to protect and displace hollow, fragile glass Christmas tree balls.

Each drawer is a styrofoam slab, preferably white to contrast with the Christmas tree balls displayed, and of a thickness to have fashioned by moulding or other conventional means a grid of spherical recesses 46 in the top surface. The recesses may be uniform in size and depth, approximately one-fourth of a spherical Christmas tree ball can be suitably recessed in each for positive cushioning grip. Corresponding-height shelves hold the drawers in parallel spaced vertical relation.

Figure 3:
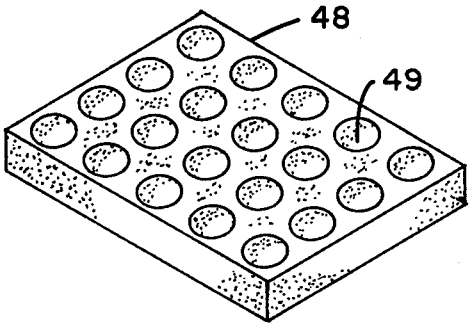
FIG. 3 is a perspective view of a similar drawer for another size Christmas tree ball.

FIG. 3 shows a drawer 48 similar to the drawer of the previous Figure but with smaller, shallower spherical recesses 49 for smaller Christmas tree ball holding. This raises smaller balls so that generally the same vertical spacing of drawers can be used. Spacing between each drawer and the drawer above is such as to provide clearance for sliding but to hold Christmas tree balls securely in the recesses. The necks of the individual balls can be upright if short and otherwise turned to the side. Drawer size is such as to fill the space allotted to each with the sliding door just clearing the front edge. Five to seven drawers are preferred, each holding twelve to twenty display Christmas tree balls in dust-free, damage protected display.

Figure 4:
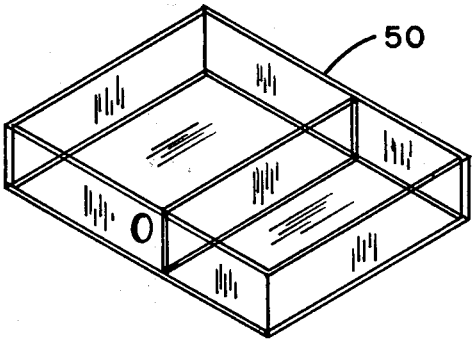
FIG. 4 is a perspective view of a Christmas tree miscellaneous accessory drawer.

FIG. 4 illustrates a preferred provision, one drawer 50 of conventional design but preferably transparent and having one or more partitions 52, to hold Christmas tree hooks and other accessories. This may be the bottom drawer if desired but if the top drawer, contents can be examined through the top of the cabinet.

Figure 5:
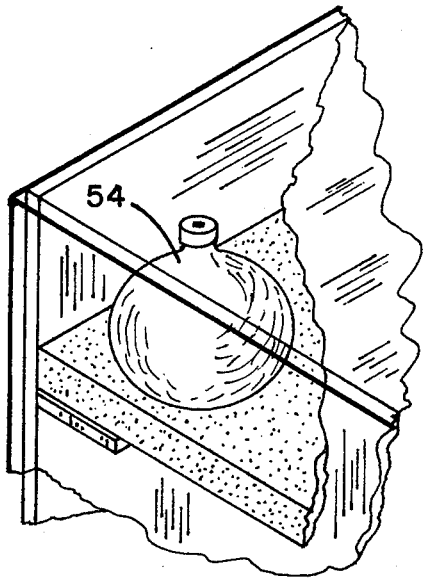
FIg. 5 is a fragmentary perspective detail of a Christmas tree ball stored and displayed in the cabinet of this invention.

FIG. 5 shows a Christmas tree ball 54 as held in the top drawer. All of an array of balls in this drawer can be seen from every angle around the room, and the white bands of the other drawers show off around the sides the three-quarter extension of the other balls held. On display in a store, the balls can be sold with the cabinet and easy exchange of a shelf or shelves from one cabinet to another enables selecting arrays to suit purchaser preferences.

Figure 6:
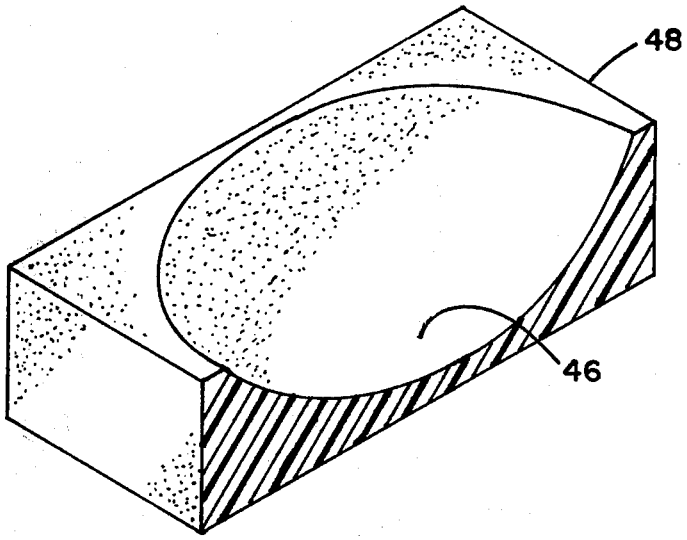
FIG. 6 is a diagrammatical perspective detail of construction of a drawer.

FIG. 6 shows a sectional proportional detail of relative depth of recess 46 to thickness of drawer 48 in a preferred embodiment.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. A cabinet for display, storage and shipment of Christmas tree balls comprising, in combination: an open-front box structure, a door, vertical flange structure slidably holding the door in position for closing the open front, a plurality of shelves fixed within the open-front box structure, a plurality of drawers held by the shelves, each drawer having a grid of recesses proportioned for holding and cushioning Christmas tree balls in the top surface of the drawer, the open front box structure having transparent left and right sides, back and top, the door being transparent, each said drawer being a styrofoam slab, and the shelves being ledge-like and including a respective plurality thereof running from front to back of the cabinet on each of said transparent left and right sides.

2. A cabinet as recited in claim 1, all said shelves being transparent.

3. A cabinet as recited in claim 2, the door having a handgrip opening therein, a handle on the transverse centerline of the top, and a partitioned drawer at the bottom of said open front box structure for holding Christmas tree ornament accessories.

* * * * *